United States Patent [19]

English

[11] Patent Number: 4,885,832

[45] Date of Patent: Dec. 12, 1989

[54] METHOD OF MAKING A RETROFIT SIDE DRAFT CLASSIFIER

[75] Inventor: William S. English, Hingham, Mass.

[73] Assignee: Sturtevant, Inc., Boston, Mass.

[21] Appl. No.: 216,085

[22] Filed: Jul. 7, 1988

[51] Int. Cl.[4] ..... B21K 21/16

[52] U.S. Cl. ..... 29/401.1; 209/135

[58] Field of Search ..... 29/401.1; 209/135, 139.1, 209/139.2, 144, 148

[56] References Cited

U.S. PATENT DOCUMENTS

| | | | |
|---|---|---|---|
| 1,933,606 | 11/1933 | Sturtevant | 209/139 |
| 3,433,422 | 3/1969 | Guenther | 241/61 |
| 3,524,544 | 8/1970 | Jager | 209/11 |
| 4,059,507 | 11/1977 | Nobuo | 209/139 A |
| 4,211,641 | 7/1980 | Jager | 209/144 |
| 4,551,241 | 11/1985 | Saverse et al. | 209/148 |

FOREIGN PATENT DOCUMENTS

| | | |
|---|---|---|
| 647888 | 7/1937 | Fed. Rep. of Germany . |
| 497966 | 1/1939 | United Kingdom . |

OTHER PUBLICATIONS

Article Entitled "Air Classifiers" by Ivan V. Klumpar and Terry A. Ring, undated and not published.

Product brochure, "The Sturtevant SD-High Efficiency Classifier", Sturtevant, Inc.

Product brochure, "The Sturtevant SD-High Efficiency Classifier", Bulletin No. B-SD-1185 Z, 1985 Sturtevant Inc.

Product brochure, "The Whirlwind Air Separator", Sturtevant, Inc., Sep. 1988, AC 5000.

Product brochure, "Air Separators", Sturtevant Mill Company, B-087-N.

*Primary Examiner*—Timothy V. Eley

*Attorney, Agent, or Firm*—Fish & Richardson

[57] ABSTRACT

A whirlwind updraft separator is converted to a side draft classifier by exchanging the rotor assembly for a rejector cage, removing the inner drum, opening the outer casing to provide for a side draft air inlet system, mounting a stationary fines chamber between the rejector cage and sealing the space beneath the side draft air inlet system to the top of the tailings cone.

8 Claims, 2 Drawing Sheets

METHOD OF MAKING A RETROFIT SIDE DRAFT CLASSIFIER

BACKGROUND OF THE INVENTION

The invention relates to the manufacture of side draft particle classifiers.

Particle classifiers separate particulate solid material into coarse and fine fractions by size and other particle properties such as density. Air classifiers sometimes called air separators are widely used, for example, in the cement industry to recover fine particulate material from raw crushed stone.

One of the older forms of air classifiers known as an updraft classifier is represented by the whirlwind air separator marketed in various forms for over 50 years by Sturtevant, Inc. of Boston, Mass., formerly the Sturtevant Mill Company. Many of the fundamental features of this design are described in U.S. Pat. No. 1,933,606 to T. J. Sturtevant issued Nov. 7, 1933. In the updraft machine, the principle air direction in the critical separation zone is vertically upward. Raw material is dropped onto a spinning distributor plate on the end of a suspended shaft inside an inner casing mounted within a spaced outer casing. The shaft also supports an internal fan above the inner casing which draws air upward through the separation zone entraining fine material and sending it down the annular space between the inner and outer casings. The heavier coarse material falls into a lower tailings cone beneath the inner casing.

As described in U.S. Pat. No. 4,551,241 issued Nov. 5, 1985 assigned to Sturtevant, Inc., the side draft classifier operates in a fundamentally different manner from the traditional updraft whirlwind classifier. In the side draft classifier, an external air source creates a radially inward rather than upward draft through a cylindrical curtain of falling raw material. The inrushing radial draft blows the fine material into a centrally located, spinning, open-bottomed rejector cage. A stationary fines collection chamber is mounted below the rejector cage. The fine material is withdrawn from the fines chamber through a duct or ducts formed through the side wall of the coarse hopper.

In comparison to the older updraft whirlwind separator, the side draft classifier achieves much higher efficiency. The side draft machine combines ultra sharp cuts with low energy consumption and low abrasion in a compact simply operated unit. Narrower particle size distribution of the product results in fewer ultra fine particles and less residue. For cement applications, controlled particle size results in higher compression strengths obtained at lower specific surface areas ($cm^2/g$ Blaine). Because of the superior design of the side draft classifier, sharp classifications are obtained with lower power consumption. Because of the higher efficiency of the side draft machine, a smaller unit of lower overall weight can be specified instead of a larger, heavier conventional whirlwind updraft separator for the same application. The newer technology increases the flexibility of the installation because of space and weight reduction and reduces the load on the supporting structure. Since the installation and structural support for the classifier represent a major fraction of the cost of the classifier, sometimes exceeding 50% of the cost of a new classifier, the side draft classifier enjoys a significant advantage in new installations because of its reduced structural requirements and greater efficiency.

SUMMARY OF THE INVENTION

Despite the fact that side draft and updraft classifiers are based on essentially incompatible design principles, the invention converts an already installed, preexisting, updraft whirlwind separator into a side draft machine, thus taking advantage of the existing installation. This mechanical metamorphosis is accomplished by eliminating the rotor assembly responsible for air flow and separation, and replacing it with a rejector cage mounted on the same shaft, removing the inner drum, opening the outer casing to provide for a radial air inlet, and mounting a stationary fines chamber beneath the rejector cage. A number of components of the updraft machine are put to use in the side draft conversion. For example, the tailings cone retains its function. The motor, gear boxes, bearings and suspended shaft are retained while the central air vanes, inner drum and valve system as well as the rotor assembly are completely eliminated. While the outside casing is retained, the space between the resulting inner and outer casings which normally would carry the fine product is not part of the material or air flow path in the retrofit classifier. The outer casing remains connected as it was to the supporting framework of the plant installation.

The result is greater efficiency at a fraction of the cost of buying and installing a completely new air classifier.

BRIEF DESCRIPTION OF THE DRAWINGS

The drawings are briefly described as follows.

DETAILED DESCRIPTION

The above-referenced drawings and following description illustrate retrofits for the Sturtevant Whirlwind Separator to create a side draft classifier generally of the type referred to in U.S. Pat. No. 4,551,241.

Figure 1:
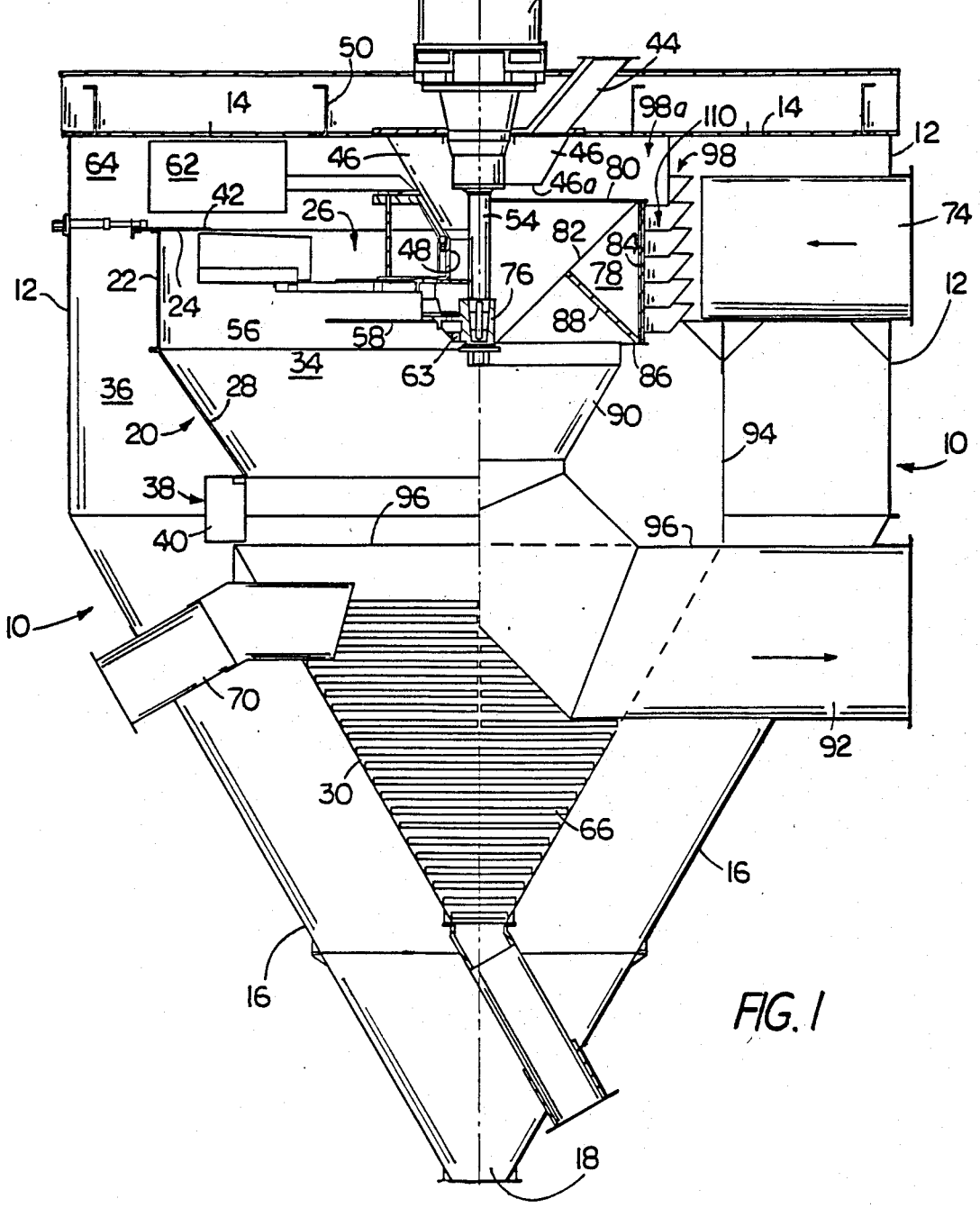
FIG. 1 is a composite schematic cross-sectional view showing a traditional whirlwind configuration to the left of the centerline and a high efficiency side draft conversion in the same housing to the right of the certerline.

As shown in FIG. 1, the components to the left of the center line correspond to those in a pre-existing traditional whirlwind configuration. The right half of the drawing illustrates the appearance of the same unit after the retrofit operation has been completed to convert it into a side draft machine. The same reference numerals on both sides of the center line refer to mechanical elements which are retained in original or modified form in the conversion.

The whirlwind air separator comprises an outer casing 10 consisting of an outside drum 12 having a closed head 14 at the upper end thereof and an external cone 16 at the lower end thereof terminating in a fines discharge spout 18. Within and spaced from the outer casing 10 is an inner casing 20 consisting of an inner drum 22 having an annular flange-like head 24 at the upper end thereof with an outlet opening 26 therein. Suspended from the drum 22 is an inner conical shell 28, and beneath and spaced vertically therefrom is another conical shell 30 called the tailings cone, terminating in a tailings discharge spout 32 for coarse material. Spout 32 projects sealingly through the lower portion of the larger coaxial cone 16 of the outer casing 10. The drum 22 and tailings cone 30 are supported by radial brackets or struts (not shown) secured to the inside of the outer casing 10.

The separating chamber 34 is defined inside the drum 22 of the whirlwind machine and the settling chamber 36 is defined between the inner and outer casings. The vertical space between the conical shells 28 and 30 of the inner casing 20 serves as an annular inlet opening 38 for the passage of air from the settling chamber 36 into the separating chamber 34. Located at this space is a series of vanes 40 arranged in a circular ring.

A series of overlapped plates 42 rest on the head 24 of the inner drum and form an iris to vary the size of the outlet opening 26 in the standard whirlwind configuration. In combination, the adjustable plates 42 are sometimes referred to as a valve.

Raw material to be graded is conducted into the separating chamber through an upper feed chute 44 through an opening in the outer casing head 14 into a conical hopper 46 secured to and depending from the head 14 with a neck 48 extending down through the outlet opening 26 in the head of the separating chamber 34.

Mounted on the outer casing head 14 are beams 50 supporting a bearing housing 52 having bearings in the lower and upper ends thereof in which a shaft 54 is journalled and extends downward through the outer casing head 14, hopper 46 and neck 48 into the separating chamber 34. A Gleason-type spiral bevel gear (not shown) fast on the shaft 54 meshes with a bevel pinion (not shown) on a horizontal drive shaft mounted directly or through a gear box to a motor not shown) supported on the head 14, typically 180° opposite the feed chute 44.

Mounted on the vertical shaft 54 beneath the hopper neck 48 is a rotor assembly 56 connected for rotation with the shaft comprising a distributor disk 58, a plurality of circumferentially spaced selector blades 60 just below the head 24 in the separation chamber and a plurality of circumferentially spaced main fan blades 62 above the inner casing in the space 64 beneath the head of the outer casing 14. The main fan blades 62 serve to develop an air current which whirls and circulates through the fan chamber 64, the settling chamber 36, the inlet opening 38, the separating chamber 34 and the outlet opening 26 in a continuous circuit. The elements of the rotor assembly 56 are connected to the bottom of the shaft 54 by means of a distributor hub 63.

Raw material is fed through the feed elements 44, 46 and 48 to the distributor 58 and are thrown outwardly thereby under the influence of centrifugal force toward the inside wall of the drum 22, which is usually lined with hard material. Meeting the upward whirling air current, the ligher particles are carried upwards through the outlet opening 26 over the head 24 of the inner casing and outwardly into the settling chamber 36 between the inner and outer casings, while the heavier particles or tailings gravitate downward through the rising air current in the separating chamber 34, the fines and tailings being discharged respectively through the spouts 18 and 32. As the coarse material flows through the tailings cone 30, concentric rings 66 attached to the inside of the cone trap some of the material to form an abrasion-resistant liner.

Figure 2:
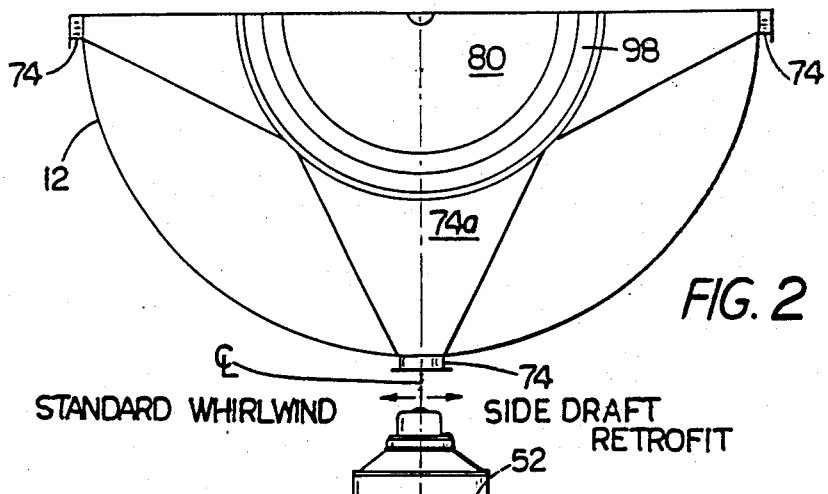
FIG. 2 is a schematic plan view of the air inlets after the side draft conversion of FIG. 1.

Fresh air ducts 70 are formed through the lower coaxial cones of the inner and outer casings. Ducts 70 may be used to inject air for cooling or hot gases for flash drying into the otherwise substantially closed circuit air stream passing through the separating zone 34. Inlet ducts 70 are designed to be accompanied by outlet ducts (not shown) for venting exhaust air arranged at a similar latitude just below the air inlet 38 in the space between the inner and outer casings To convert the whirlwind separator into a side draft classifier, openings for radial air inlets 74 are cut in the drum 12 as shown on the right side of FIG. 1 as well as in FIG. 2. The rotor assembly 56 is disassembled to the extent necessary and the distributor plate 58, selector blades 60 and fan blades 62 and associated supporting brackets are removed. The distributing hub 63 is replaced with a simpler hub 76 as shown supporting a rejector cage 78 having an upper distribution disk or plate 80 supported by a conical member 82. A plurality of vertical circumferentially spaced rejector pins 84 are suspended from the outer perimeter of the distribution plate 80 and are supported by a lower ring 86 connected to the supporting cone 82 by means of diagonal struts 88. The bottom of the rejector cage 78 is thus open. To make room for the other components of the side draft configuration, the inner casing 20 including the drum 22 and upper cone 28, is completely removed along with the head 24, valve members 42 and the ring vane assembly 40. In place of these elements, a stationary fines collection chamber 90 is disposed coaxially beneath the open bottom of the rejector cage 78. The fines chamber 90 is connected to a fines discharge duct or ducts which extend out through an opening formed in the walls of the tailing cone 30 and the outer cone 16. Fines discharge duct 92 also structurally supports the fines chamber 90. A coaxial drum 94, larger in diameter than old drum 22, is mounted directly on top of the tailings cone 30 as shown and has a diameter which is approximately the same as the top 96 of the tailings cone. Drum 94 supports the larger inner end **74*a* of the radial air ducts. Between the inner end 74*a* of the radial ducts and the rejector cage 78 are a plurality of truncated conical deflectors 98 which are supported on brackets (not shown) between the head 14 and the drum 94. The feed hopper system is modified by removing the feed neck 48 and sectioning the conical feed hopper 46 surrounding the bearing housing 52 for the shaft 54 to form a more truncated feed cone terminating in a lower discharge end 46*a* well above the distribution plate 80 on top of the rejector cage as shown. The same feed chute 44 forms the inlet to the conical feed hopper 46**.

In order to accommodate the change-over from the rotor assembly 56 to the rejector cage and accompanying elements, a central portion of the head 14 of the outer casing may be removed so that the rotor elements can be withdrawn through the top of the casing and the new components lowered in. In fact, in the commercial embodiment of the whirlwind separator portions of the head 14 are designed to be removable to service the rotor assembly. Ideally, the entire bearing assembly 52 with rotor shaft 54 and rotor assembly 56 attached is withdrawn intact from the casing after opening the head 14 to the extent necessary. Once the rotor shaft 54 and associated components are withdrawn from the casing, the rotor assembly can be dismounted and a prefabricated rejector cage can be installed on the rotor shaft and then lowered back into the casing at the same position.

Figure 4:
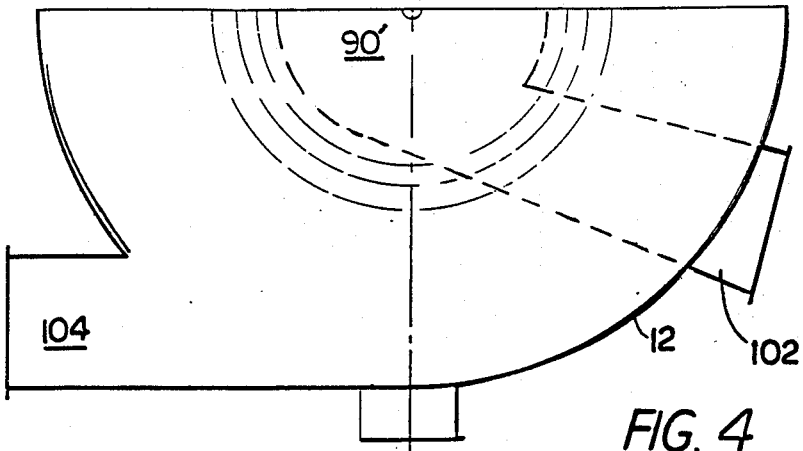
FIG. 4 is a schematic plan view illustrating the air inlet an fines outlet of the retrofit side draft classifier of FIG. 3 after conversion.
Figure 3:
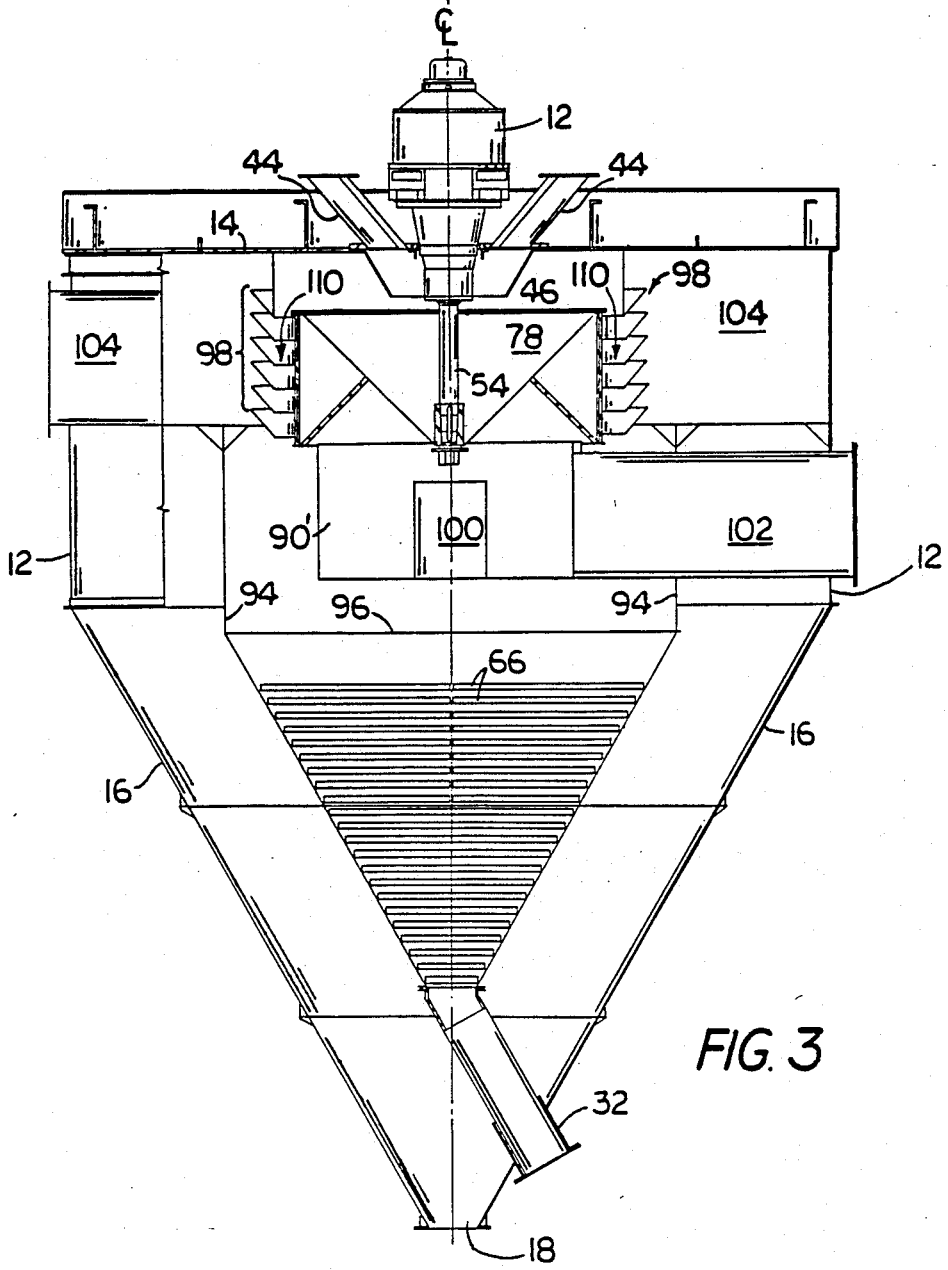
FIG. 3 is a cross-sectional view of an alternate embodiment of the retrofit side draft conversion in which the air inlet and fines outlet are arranged tangentially in a volute configuration.

In FIGS. 3 and 4, a modification to the fines chamber and air inlet and outlet system is shown. A cylindrical fines chamber 90 includes a central cylindrical body 100 which keeps particulate matter out of a potential dead zone in the middle of the fines chamber. The fines discharge outlet 102 is tangential to the fines chamber 90' and forms a tapered opening through the outer casing drum 12 rather than through the lower cone 16.

In lieu of the plurality of radial air inlets (FIG. 2), a volute air inlet 104 can be defined through the side wall 12 of the drum as shown in FIGS. 3 and 4. The volute approach is described in detail in U.S. Pat. No. 4,551,241. A second feed chute 44 can also be added as shown in FIG. 3.

In operation, the retrofit side draft classifier operates essentially in the same manner as the side draft classifiers described in U.S. Pat. No. 4,551,241. Raw particulate feed material is introduced into the system through the feed inlets 44 and 46 and drops onto the spinning distribution plate 80. Centrifugal force imparts radial motion to the material so that it slides off the periphery of the distribution plate and falls or is deflected downward by deflector 98*a* (FIG. 1) to create a cylindrical curtain of falling particulate material which descends around the cage through the separation zone defined between stationary deflectors 98 and the revolving pins 84 on the rejector cage. In contrast to the whirlwind separator, the separation zone is confined to a small cylindrical region closer to the axis of the machine and the direction of flow of particulate material through the separation zone is exactly opposite that of the whirlwind separator, i.e., vertically downward instead of upward. Meanwhile, air supplied through the radial or volute air inlets intersects the particulate curtain in the separation zone and directs smaller particles into the interior of the rejector cage from which they fall into the stationary fines chamber 90 and are withdrawn through the discharge 92 by means of one or more external cyclone collectors whose particle free exhaust air is returned to the air inlet 74.

Coarse particles drop the full distance through the separation zone through the newly added drum 94 into the tailings cone 30 and out the tailings discharge spout 32. Thus another difference in operation lies in the fact that the coarse particulate material traverses the entire separation zone in the side draft classifier. In the whirlwind separator, the separation zone is primarily above the distributor plate and thus the heavier particles which are not blown far above the distribution plate do not traverse the axial length of the separation zone. Moreover, in the side draft classifier the close confines of the deflector array 98 and the register pins 84 causes particles to bounce back and fourth with relatively high impact so that the chances increase that smaller particles borne by coarse particles will be separated form the coarse particles and carried into the rejector cage. Unlike the whirlwind separators, the air velocity can be controlled independently of the rotor speed thus enhancing control and allowing sharper gradations.

Many variations and additions can be made without departing from the basic principle of the invention. For example, a plurality of volute type air inlets, each covering a fraction of 360°, can be accommodated as in the various designs of side draft classifiers commercially available from Sturtevant, Inc. Although the conical deflectors 98 are valuable for streamlining the air flow toward the rejector cage while deflecting rejected particles back toward the rejector cage, other screening elements can be employed to define the separation zone. In addition, for example, it may be found that the air inlet vane ring 40 can be left in place and sealed off instead of completely removing it as shown.

Thus the embodiments described herein are intended to be illustrative. Other embodiments are within the appended claims.

I claim:

1. A method of making a side draft particle classifier comprising the steps of:

locating an already installed updraft whirlwind separator including an outer casing having an outside upper drum and a lower fines cone and a coaxial inner casing comprising an inside upper drum spaced vertically from an inner tailings cone by an air inlet ring and having a rotor assembly comprising a lower distribution plate and an upper main fan blade assembly attached to a coaxial rotor shaft suspended from a bearing housing mounted on the head of the outer casing surrounded by a coaxial feed cone connected to a feed chute for delivering raw material to the lower distribution plate whereby the material is flung outwardly by centrifugal force into an upward air stream which takes the fine particles up over the inside drum and into the space between the inner and outer casings, the coarse material falling into the tailings cone, removing the rotor assembly from the shaft, removing the inside drum, shortening the existing coaxial feed cone, mounting a side draft classifier rejector cage on the existing rotor shaft for rotation therewith, said rejector cage having an upper distribution plate beneath the shortened feed cone, installing a stationary fines chamber beneath the rejector cage with an outlet duct for the fines chamber extending through an opening in the existing outer casing, mounting a side draft air inlet system around the newly added rejector cage for creating a radial inward draft through the wall of the existing outer casing, sealing the space below the newly added air inlet system to the top of the tailings cone, and mounting a cylindrical screening element between the newly added side draft air inlet and rejector cage to define the new separation zone.

2. The method of claim 1, further comprising removing said air inlet ring above the tailings cone.

3. The method of claim 1, further comprising forming an opening in the existing tailings cone and extending an outlet duct for the fines chamber through the newly formed tailings cone opening.

4. The method of claim 3, further comprising extending an outlet duct for the fines chamber out through an opening in the newly added drum above the tailings cone.

5. The method of claim 1, further comprising forming a coaxial inner drum between the top of the tailings cone and the newly added air inlet system.

6. The method of claim 1, wherein said side draft air inlet system comprises a plurality of radial ducts.

7. The method of claim 1, wherein said side draft air inlet system comprises at least one volute-type duct.

8. The method of claim 1, wherein said existing whirlwind separator further includes a valve assembly for defining the opening at the top of the inside drum, said method further including removing said valve assembly.

* * * * *

UNITED STATES PATENT AND TRADEMARK OFFICE

CERTIFICATE OF CORRECTION

PATENT NO. : 4,885,832

DATED : December 12, 1989

INVENTOR(S) : William S. English

It is certified that error appears in the above-identified patent and that said Letters Patent is hereby corrected as shown below:

In FIG. 1, the numeral 60 and an arrow for numeral 56 should be added as indicated below.

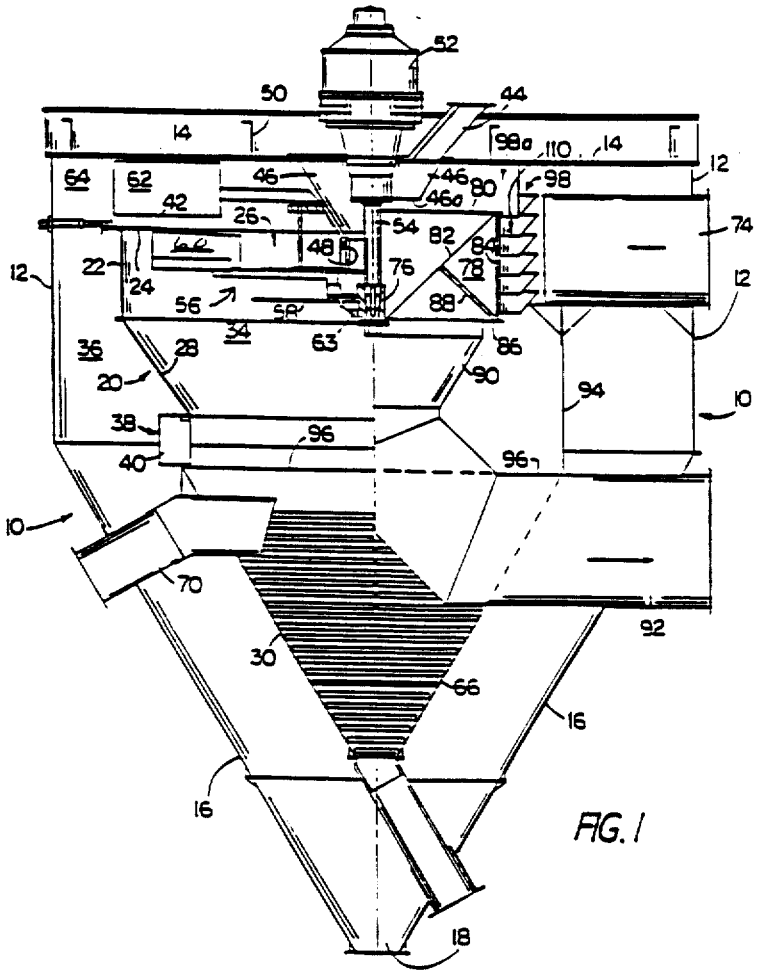

FIG. 1

UNITED STATES PATENT AND TRADEMARK OFFICE

CERTIFICATE OF CORRECTION

PATENT NO. : 4,885,832

DATED : December 12, 1989

INVENTOR(S) : William S. English

It is certified that error appears in the above-identified patent and that said Letters Patent is hereby corrected as shown below:

Column 2, line 36, "cert-erline" should be --centerline--.
Column 3, line 39, "not shown)" should be --(not shown)--.
Column 3, line 61, "ligher" should be --lighter--.
Column 4, line 12, "casings" should be --casings.--.
Column 5, line 6, "chamber 90" should be --chamber 90'--.
Column 5, line 53, "register" should be --rejector--.
Column 5, line 54, "fourth" should be --forth--.

Signed and Sealed this

Twentieth Day of November, 1990

*Attest:*

*Attesting Officer*

HARRY F. MANBECK, JR.

*Commissioner of Patents and Trademarks*